US011274407B1

(12) United States Patent
James

(10) Patent No.: US 11,274,407 B1
(45) Date of Patent: Mar. 15, 2022

(54) PET WASTE VACUUM

(71) Applicant: William James, Osprey, FL (US)

(72) Inventor: William James, Osprey, FL (US)

( * ) Notice: Subject to any disclaimer, the term of this patent is extended or adjusted under 35 U.S.C. 154(b) by 35 days.

(21) Appl. No.: 16/934,101

(22) Filed: Jul. 21, 2020

(51) Int. Cl.
*E01H 1/12* (2006.01)

(52) U.S. Cl.
CPC ... *E01H 1/1206* (2013.01); *E01H 2001/1226* (2013.01)

(58) Field of Classification Search
CPC ..... E01H 1/1206; E01H 2001/1226
See application file for complete search history.

(56) References Cited

U.S. PATENT DOCUMENTS

| | | | | |
|---|---|---|---|---|
| 4,185,355 | A * | 1/1980 | Williams | A47L 5/24 15/344 |
| 5,661,873 | A | 9/1997 | Karet | |
| 5,771,531 | A * | 6/1998 | Swartz | A47L 5/24 15/324 |
| 6,066,211 | A | 5/2000 | Sandell | |
| 6,115,879 | A | 9/2000 | Mitchell | |
| 6,647,586 | B2 | 11/2003 | Rogert | |
| 7,003,846 | B2 | 2/2006 | Holtz | |
| 7,077,172 | B2 * | 7/2006 | Perkitny | E01H 1/1206 141/10 |
| 7,404,230 | B1 | 7/2008 | Phillips | |
| D664,726 | S | 7/2012 | McCarthy | |
| 9,920,494 | B2 * | 3/2018 | Rivadeneira | A01K 1/035 |
| 2008/0030032 | A1 * | 2/2008 | Gill | A47L 5/28 294/1.3 |

FOREIGN PATENT DOCUMENTS

| | | |
|---|---|---|
| DE | 102005027908 | 9/2009 |

* cited by examiner

*Primary Examiner* — Stephen A Vu

(57) ABSTRACT

The pet waste vacuum is a vacuum cleaner. The pet waste vacuum is configured for use in picking up the elimination of a companion animal from a surface. The pet waste vacuum incorporates a housing module, a vacuum module, a storage module, a collection module, and a control circuit. The housing contains the vacuum module, the storage module, a collection module, and the control circuit. The storage module is the structure that receives and contains the elimination. The vacuum module provides the motive forces necessary to: a) draw the elimination into the collection module; and, b) move the elimination through the collection module and into the storage module. The control circuit is an electric circuit that: a) controls the operation of the pet waste vacuum; and, b) provides the electrical energy necessary to operate the pet waste vacuum.

18 Claims, 7 Drawing Sheets

PET WASTE VACUUM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of street cleaning including removing undesirable matter from a surface, more specifically, a litter picker for picking up excrement. (E01H1/1206)

SUMMARY OF INVENTION

The pet waste vacuum is a vacuum cleaner. The pet waste vacuum is configured for use in picking up the elimination of a companion animal from a surface. The pet waste vacuum comprises a housing module, a vacuum module, a storage module, a collection module, and a control circuit. The housing contains the vacuum module, the storage module, a collection module, and the control circuit. The storage module is the structure that receives and contains the elimination. The vacuum module provides the motive forces necessary to: a) draw the elimination into the collection module; and, b) move the elimination through the collection module and into the storage module. The control circuit is an electric circuit that: a) controls the operation of the pet waste vacuum; and, b) provides the electrical energy necessary to operate the pet waste vacuum.

These together with additional objects, features and advantages of the pet waste vacuum will be readily apparent to those of ordinary skill in the art upon reading the following detailed description of the presently preferred, but nonetheless illustrative, embodiments when taken in conjunction with the accompanying drawings.

In this respect, before explaining the current embodiments of the pet waste vacuum in detail, it is to be understood that the pet waste vacuum is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the pet waste vacuum.

It is therefore important that the claims be regarded as including such equivalent construction insofar as they do not depart from the spirit and scope of the pet waste vacuum. It is also be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
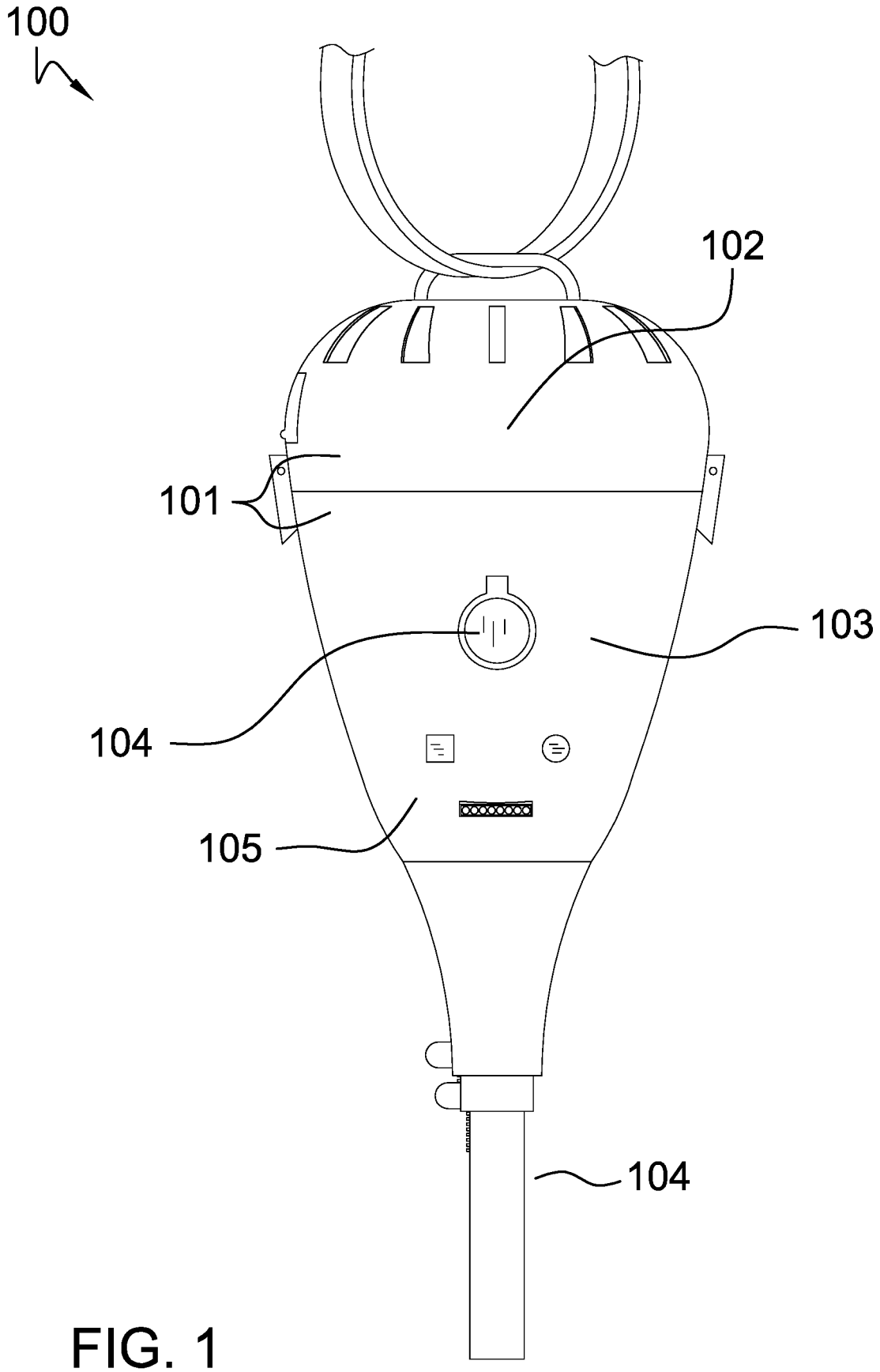
FIG. 1 is a front view of an embodiment of the disclosure.
Figure 2:
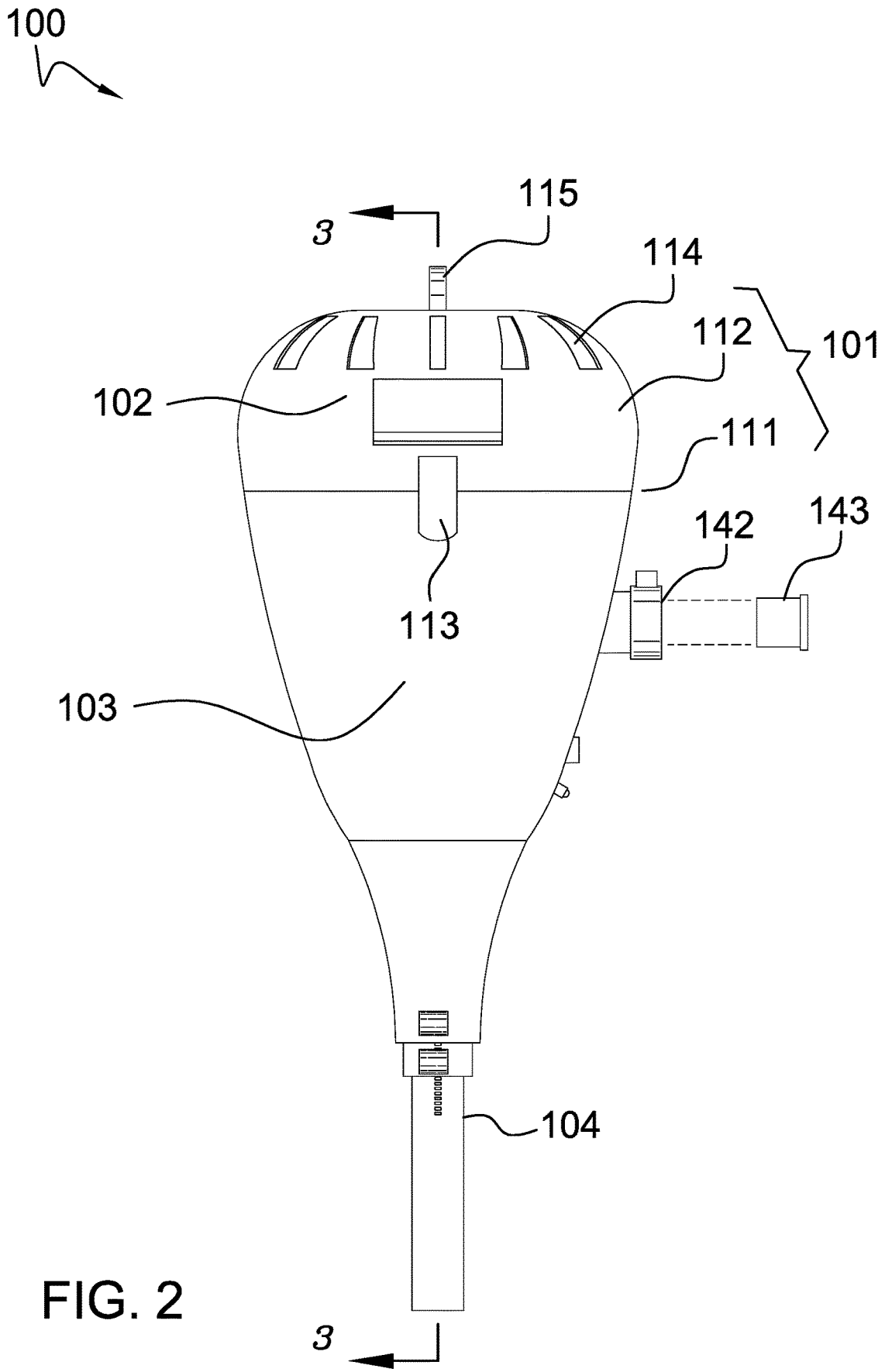
FIG. 2 is a side view of an embodiment of the disclosure.
Figure 3:
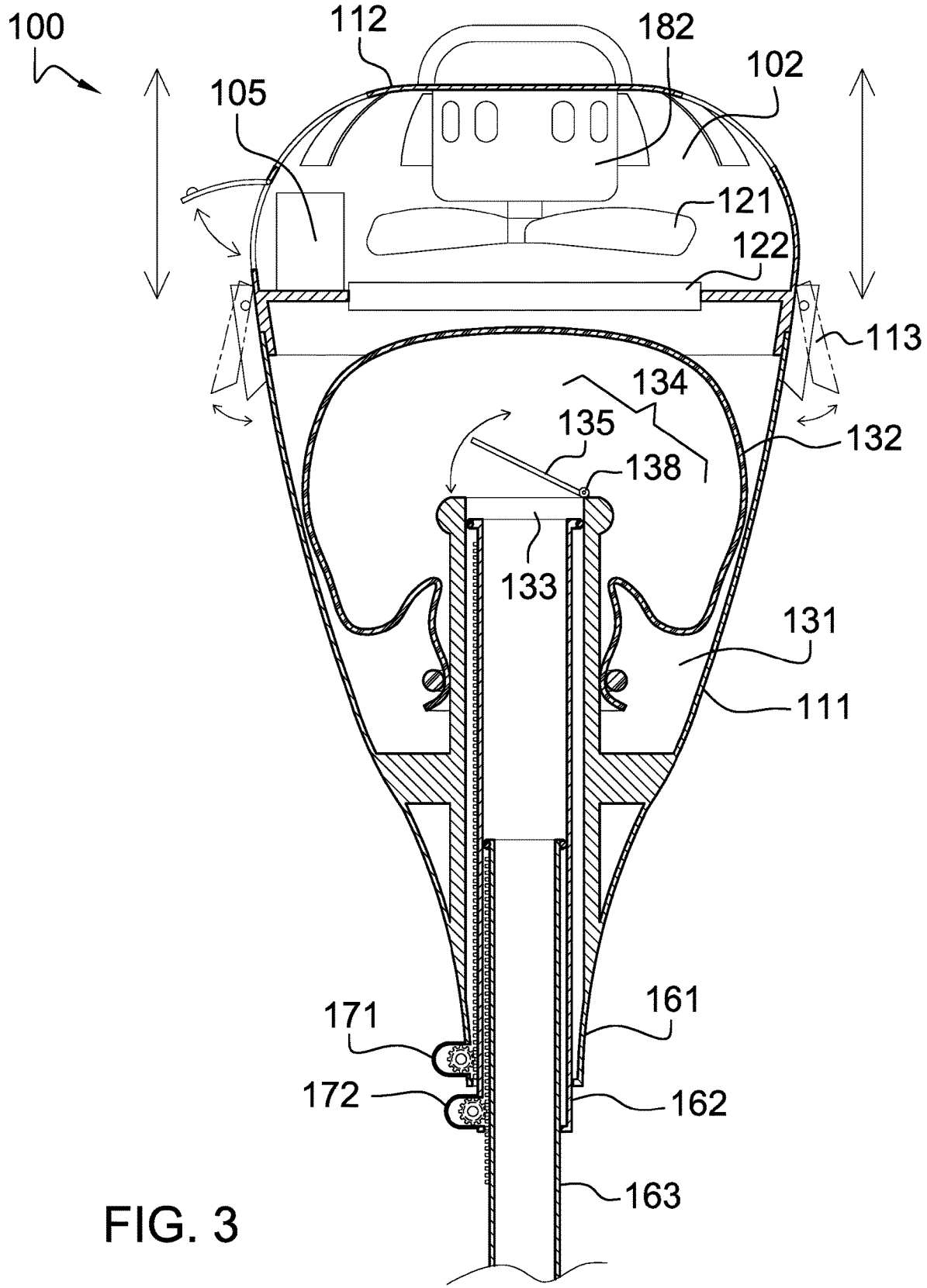
FIG. 3 is a cross-sectional view of an embodiment of the disclosure across 3-3 as shown in FIG. 2.
Figure 4:
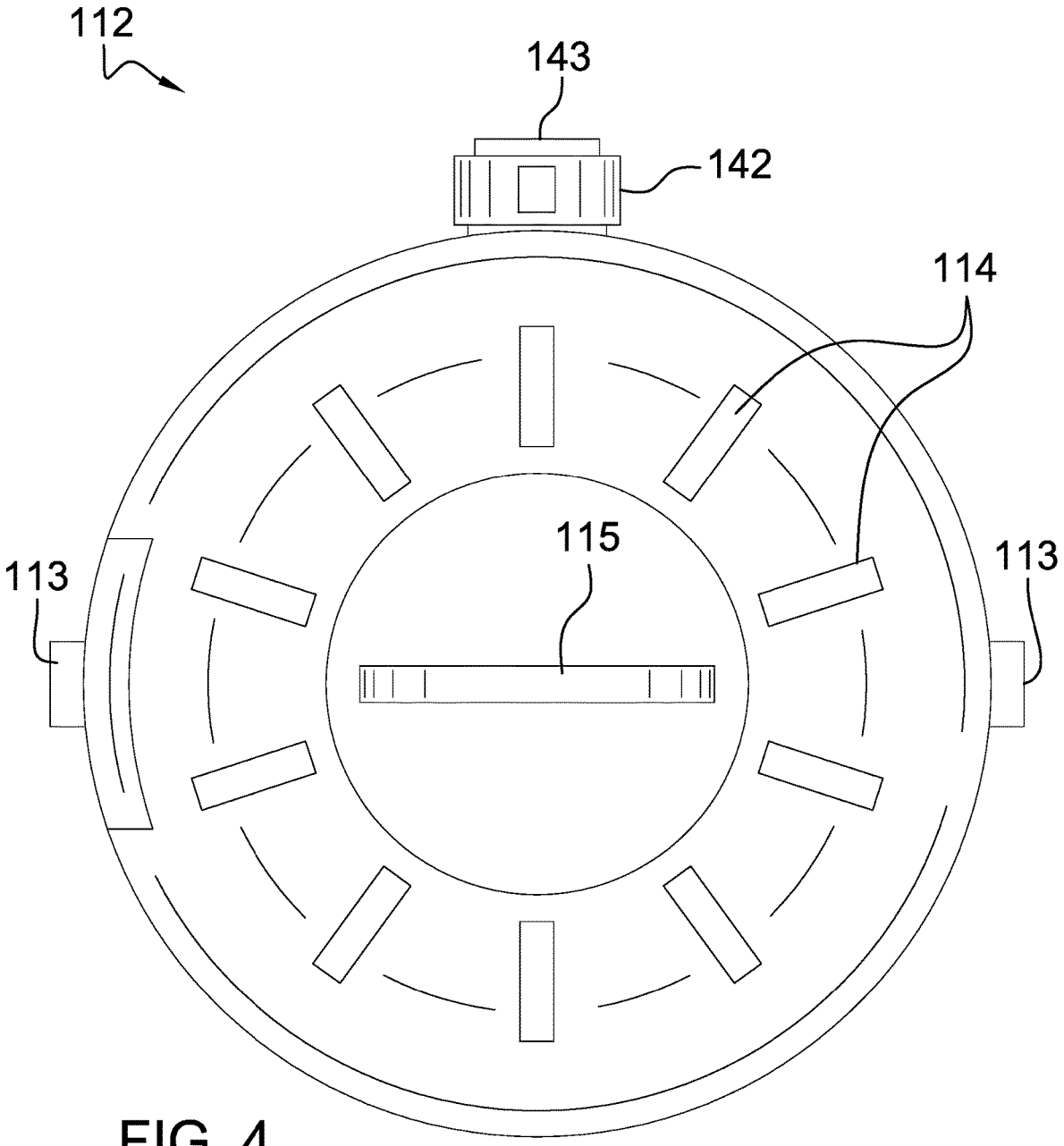
FIG. 4 is a top view of an embodiment of the disclosure.
Figure 5:
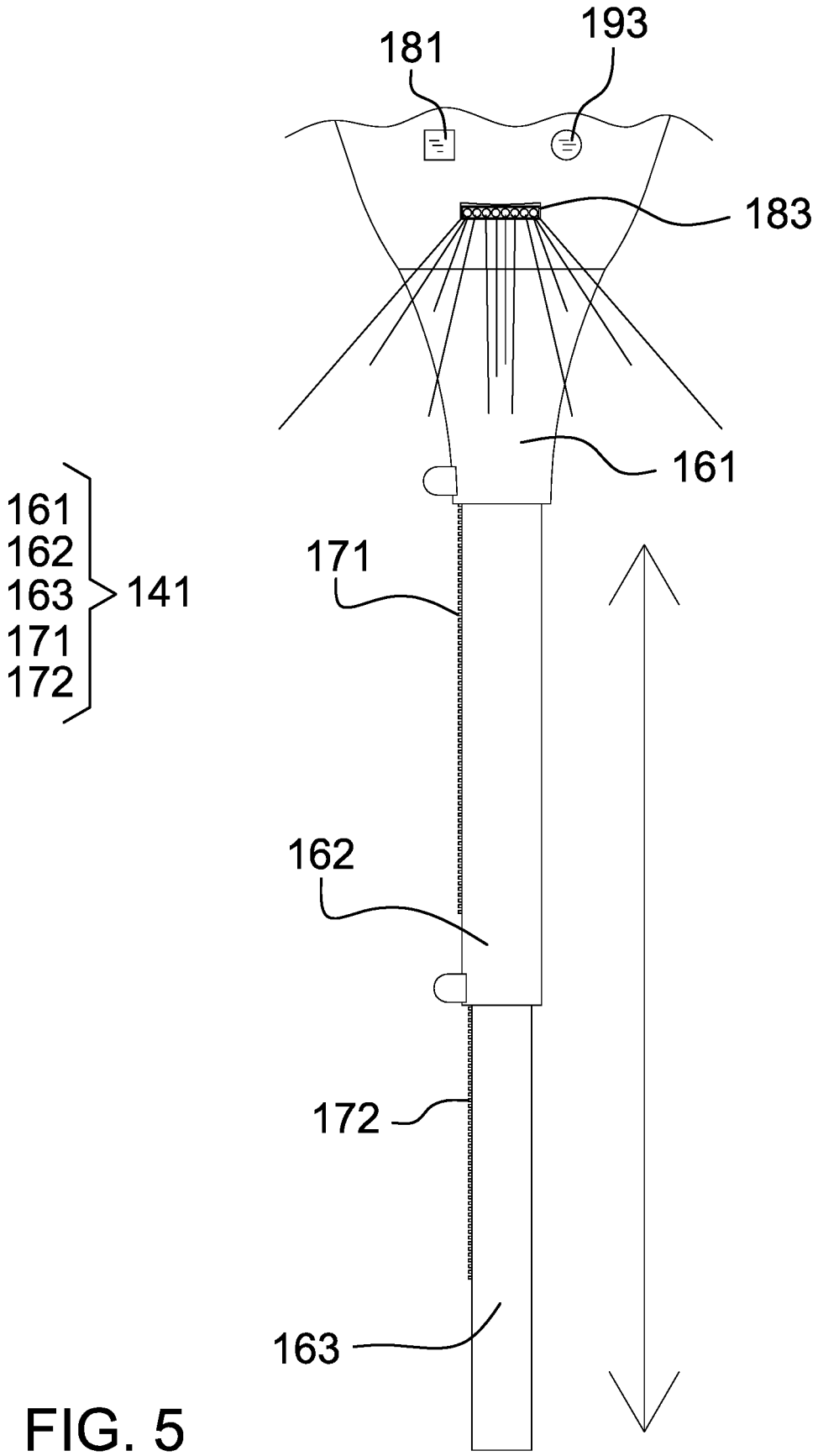
FIG. 5 is an in-use view of an embodiment of the disclosure.
Figure 6:
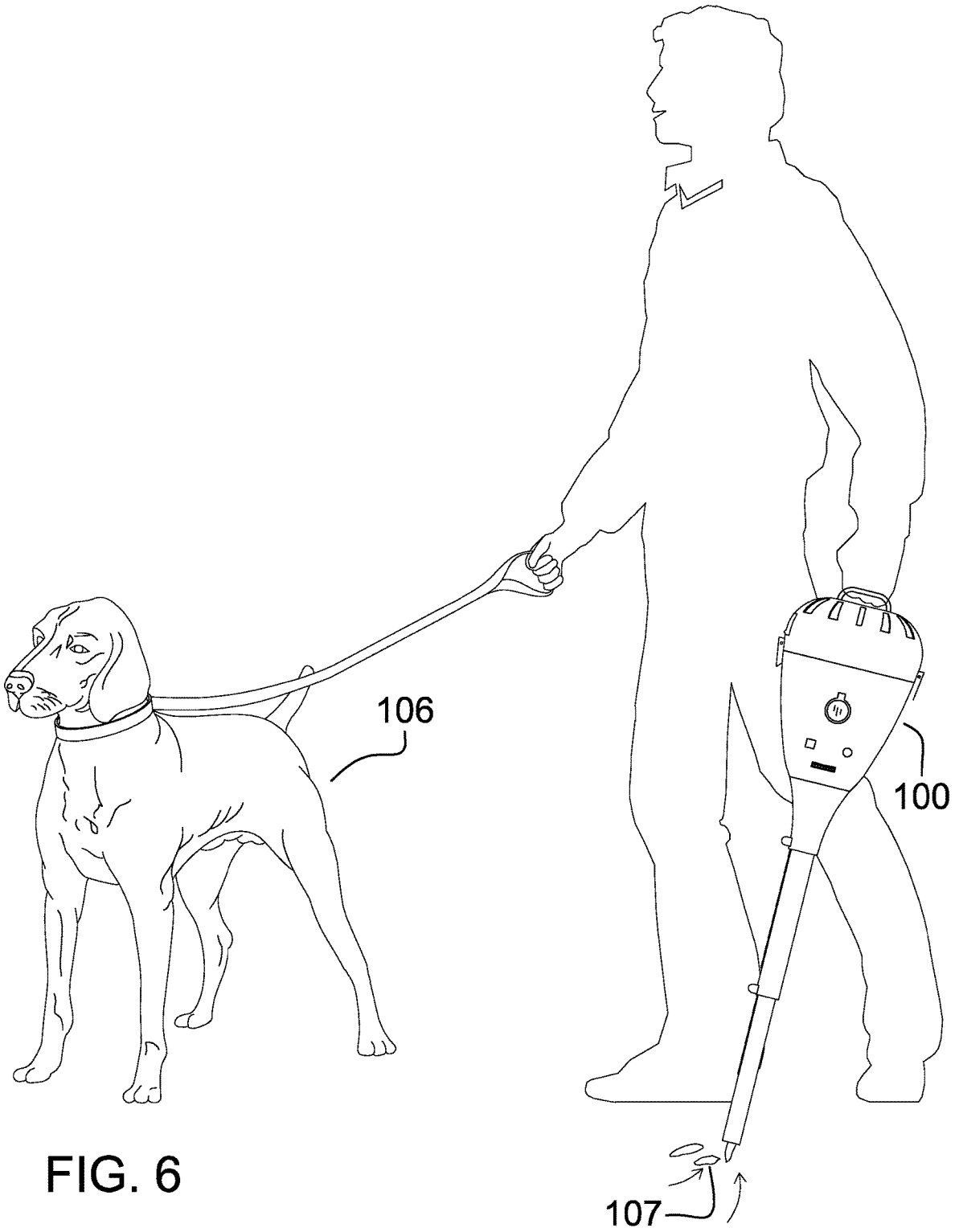
FIG. 6 is an in-use view of an embodiment of the disclosure.
Figure 7:
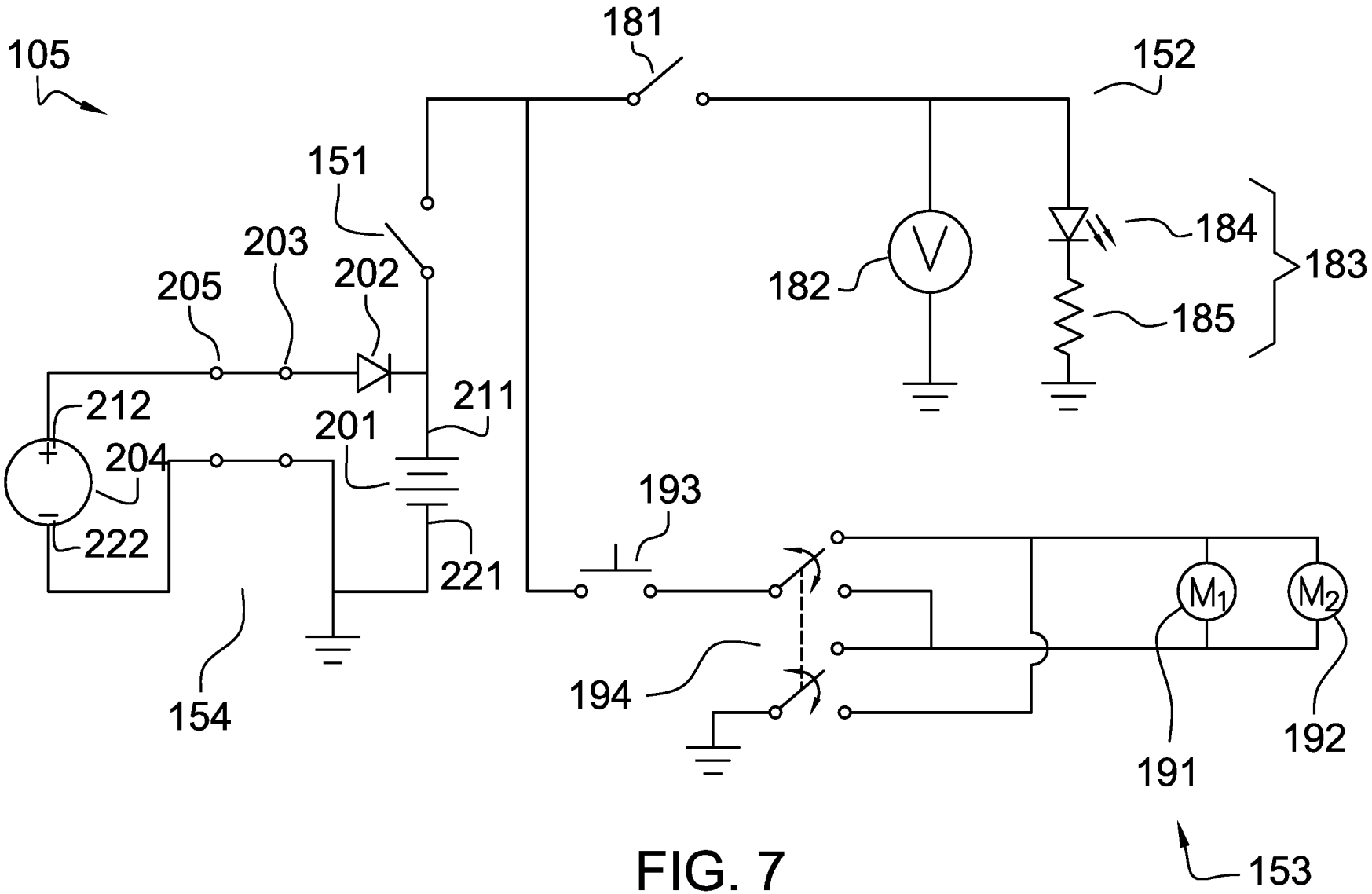
FIG. 7 is a schematic view of an embodiment of the disclosure.

Detailed reference will now be made to one or more potential embodiments of the disclosure, which are illustrated in FIGS. 1 through 7.

The pet waste vacuum 100 (hereinafter invention) is a vacuum cleaner. The invention 100 is configured for use in picking up the elimination 107 of a companion animal 106 from a surface. The invention 100 comprises a housing module 101, a vacuum module 102, a storage module 103, a collection module 104, and a control circuit 105. The housing contains the vacuum module 102, the storage module 103, a collection module 104, and the control circuit 105. The storage module 103 is the structure that receives and contains the elimination 107. The vacuum module 102 provides the motive forces necessary to: a) draw the elimination 107 into the collection module 104; and, b) move the elimination 107 through the collection module 104 and into the storage module 103. The control circuit 105 is an electric circuit that: a) controls the operation of the invention 100; and, b) provides the electrical energy necessary to operate the invention 100.

The companion animal 106 is defined elsewhere in this disclosure. The elimination 107 is defined elsewhere in this disclosure.

The housing module 101 forms the exterior shell of the invention 100. The housing module 101 contains the vacuum module 102, the storage module 103, the collection module 104, and the control circuit 105, and the collected elimination 107 from the companion animal 106. The housing module 101 is formed with all apertures and form factors necessary to allow the housing module 101 to accommodate the use and operation of the vacuum module 102, the storage module 103, the collection module 104, and the control circuit 105. The housing module 101 comprises a master housing 111 and a vacuum housing 112. The master housing 111 contains the storage module 103 and the collection module 104. The vacuum housing 112 contains the vacuum module 102 and the control circuit 105.

The master housing 111 is a rigid casing. The master housing 111 contains the storage module 103, the collection module 104, and the control circuit 105. The master housing 111 is formed with all apertures and form factors necessary to allow the master housing 111 to accommodate the use and operation of the storage module 103, the collection module 104, and the control circuit 105. Methods to form a master housing 111 suitable for the purposes described in this disclosure are well-known and documented in the mechanical arts.

The vacuum housing 112 is a rigid casing. The vacuum housing 112 contains the vacuum module 102. The vacuum housing 112 is formed with all apertures and form factors necessary to allow the vacuum housing 112 to accommodate the use and operation of the vacuum module 102. Methods to form a vacuum housing 112 suitable for the purposes described in this disclosure are well-known and documented in the mechanical arts. The vacuum housing 112 comprises a plurality of latches 113, a plurality of exhaust ports 114, and a handle 115.

The plurality of latches 113 forms a fastening device. The plurality of latches 113 secures the vacuum module 102 to the storage module 103. Each of the plurality of exhaust ports 114 is a fluid port formed through the vacuum housing 112. The air flow passing through the plurality of exhaust ports 114 discharges through the plurality of exhaust ports 114. The handle 115 is a grip that attaches to the exterior surface of the vacuum housing 112. The handle 115 is used to carry and manipulate the invention 100.

The vacuum module 102 is a mechanical structure. The vacuum module 102 is an electrically powered structure. The vacuum module 102 generates a pressure differential that pumps an air flow through the collection module 104 and the storage module 103 into the vacuum module 102. The vacuum module 102 generates this pressure differential by pumping air out of the vacuum module 102 into the atmosphere. The mass of the air flow passing through the invention 100 draws the elimination 107 of the companion animal 106 through the collection module 104 into the storage module 103. The elimination 107 of the companion animal 106 is captured in the storage module 103. The vacuum module 102 comprises a vacuum pump 121 and a vacuum filter 122.

The vacuum pump 121 is a mechanical structure. The vacuum pump 121 is an electrically powered structure. The control circuit 105 powers the operation of the vacuum pump 121. The control circuit 105 controls the operation of the vacuum pump 121. The vacuum pump 121 is a rotating structure. The vacuum pump 121 generates the pressure differential that draws air through the collection module 104 and the storage module 103. The vacuum pump 121 generates the pressure differential necessary to receive the air flow into the vacuum module 102. The vacuum pump 121 generates the pressure differential necessary to discharge the air flow from the vacuum module 102.

The vacuum filter 122 is a surface filter. The surface filter is defined elsewhere in this disclosure. The air flow passing through the invention 100 is filtered for particulates before entering the vacuum pump 121. The vacuum filter 122 protects the vacuum pump 121 from damage by the filtered particulates.

The storage module 103 is a hollow structure. The storage module 103 is a containment structure. The storage module 103 receives that air and the elimination 107 of the companion animal 106 pumped by the vacuum module 102 through the collection module 104. The storage module 103 filters the solid matter from the air flow that is drawn into the storage module 103. The storage module 103 discharges the filtered airflow into the vacuum module 102. The storage module 103 comprises a containment shell 131, a containment bag 132, an intake port 133, and a flap valve 134.

The containment shell 131 is a rigid structure. The containment shell 131 is a hollow structure. The containment shell 131 forms a fluidic connection between the collection module 104 and the vacuum module 102. The containment shell 131 contains the containment bag 132, the intake port 133, and the flap valve 134. The containment shell 131 receives and stores the collected elimination 107 of the companion animal 106.

The containment bag 132 is a gas permeable bag. The containment bag 132 forms a bag. The containment bag 132 removably attaches to the intake port 133. The containment bag 132 encloses the intake port 133 such that everything that passes through the intake port 133 is captured within the containment bag 132. The containment bag 132 filters the solid matter from the air flow that is drawn into the containment bag 132. The containment bag 132 stores the elimination 107 of the companion animal 106 in anticipation of disposal.

The intake port 133 is a fluid port. The fluid port is defined elsewhere in this disclosure. The intake port 133 forms a fluidic connection between the collection module 104 and the storage module 103. The containment bag 132 attaches to and encloses the intake port 133 such that the elimination 107 of the companion animal 106 is contained within the intake port 133 immediately on entry into the storage module 103.

The flap valve 134 is a valve that attaches to the intake port 133. The flap valve 134 is a rotating structure. The flap valve 134 rotates between putting the intake port 133 into an open position and putting the intake port 133 into a closed position. The flap valve 134 comprises a valve plate 135 and a valve hinge 136.

The valve plate 135 is a rigid structure. The valve plate 135 has a disk structure. The valve plate 135 forms a flap within the storage module 103. The valve plate 135 is sized such that the valve plate 135 encloses the intake port 133 when the flap valve 134 is rotated to the closed position.

The valve hinge 136 is a spring-loaded hinge. The valve hinge 136 attaches the valve plate 135 to the flap valve 134 such that the valve plate 135 rotates between the closed position and the open position. The closed position and the open position are defined elsewhere in this disclosure. The spring structure of the valve hinge 136 returns and secures the valve plate 135 in the closed position. The vacuum generated by the vacuum module 102 rotates the valve plate 135 into the open position such that the containment bag 132 can receive the elimination 107 of the companion animal 106 during the use of the invention 100.

The collection module 104 is a mechanical structure. The collection module 104 forms a plurality of intake ports used to draw the air and the elimination 107 of the companion animal 106 into the invention 100. The collection module 104 incorporates a telescopic structure. The collection module 104 comprises a telescopic module 141 and an auxiliary port 142.

The telescopic module 141 is a composite prism structure. The telescopic module 141 is a tubular structure. The telescopic module 141 forms a fluidic connection between the exterior of the invention 100 and the storage module 103. The telescopic module 141 receives the elimination 107 of the companion animal 106 into the invention 100. The vacuum generated by the vacuum module 102 provides the motive forces that: a) draw the elimination 107 into the telescopic module 141; and, b) transport the elimination 107 through the telescopic module 141 into the storage module 103. The span of the length of the center axis of the composite prism structure of the telescopic module 141 is adjustable.

The telescopic module 141 is a telescopic structure that comprises a first arm 161, a second arm 162, and a first detent 171. The first detent 171 is a mechanical device that locks and secures the first arm 161 to the second arm 162. The first arm 161 is a hollow prism that is further defined with an inner dimension. The second arm 162 is a hollow prism that is further defined with an outer dimension. The second arm 162 is geometrically similar to the first arm 161. The span of the outer dimension of the second arm 162 is lesser than the span of the inner dimension of the first arm 161 such that the second arm 162 inserts into the first arm 161 in a telescopic fashion to form a composite prism structure.

The span of the length of the telescopic module 141 adjusts by adjusting the relative position of the second arm 162 within the first arm 161. The position of the second arm 162 relative to the first arm 161 is held in position using the first detent 171. The first detent 171 is selected from the group consisting of a cotter pin, a G snap collar, a cam lock collar, a threaded clutch, a split collar lock, and a spring loaded ball lock.

The telescopic module 141 further comprises a third arm 163, and a second detent 172. The second detent 172 is a mechanical device that locks and secures the third arm 163 to the second arm 162. The second arm 162 is a hollow prism that is further defined with an inner dimension. The third arm 163 is a hollow prism that is further defined with an outer dimension. The third arm 163 is geometrically similar to the second arm 162. The span of the outer dimension of the third arm 163 is lesser than the span of the inner dimension of the second arm 162 such that the third arm 163 inserts into the second arm 162 in a telescopic fashion to form a composite prism structure.

The span of the length of the telescopic module 141 adjusts by adjusting the relative position of the third arm 163 within the second arm 162. The position of the third arm 163 relative to the second arm 162 is held in position using the second detent 172. The second detent 172 is selected from the group consisting of a cotter pin, a G snap collar, a cam lock collar, a threaded clutch, a split collar lock, and a spring loaded ball lock.

In the first potential embodiment of the first detent 171 and the second detent 172 are rack and pinion structures. The rack and pinion are defined elsewhere in this disclosure.

The pinion of the first detent 171 attaches to the first arm 161. The rack of the first detent 171 attaches to the second arm 162. The pinion of the first detent 171 attaches to the control circuit 105 such that the control circuit 105 controls the rotation of the pinion relative to the rack. The rotation of the pinion of the first detent 171 moves the rack of the first detent 171 such that the second arm 162 moves relative to the first arm 161.

The pinion of the second detent 172 attaches to the second arm 162. The rack of the second detent 172 attaches to the third arm 163. The pinion of the second detent 172 attaches to the control circuit 105 such that the control circuit 105 controls the rotation of the pinion relative to the rack. The rotation of the pinion of the second detent 172 moves the rack of the second detent 172 such that the third arm 163 moves relative to the second arm 162.

The auxiliary port 142 is a fluid port that is formed in the containment shell 131 of the storage module 103. The auxiliary port 142 forms a fluidic connection between the exterior of the invention 100 and the storage module 103. The vacuum generated by the vacuum module 102 provides the motive forces that: a) draw the elimination 107 into the auxiliary port 142; and, b) transport the elimination 107 through the auxiliary port 142 into the containment bag 132 of the storage module 103. The auxiliary port 142 further comprises an auxiliary plug 143. The auxiliary plug 143 is a fluid plug. The auxiliary plug 143 inserts into the auxiliary port 142 when the auxiliary port 142 is not in use. The auxiliary plug 143 forms a fluid impermeable seal with the auxiliary port 142.

The control circuit 105 is an electric circuit. The control circuit 105 powers the operation of the vacuum module 102 and the collection module 104. The control circuit 105 controls the operation of the vacuum module 102 and the collection module 104. The control circuit 105 generates an illumination that allows for the identification and capture of the elimination 107 of the companion animal 106. The control circuit 105 extends and retracts the telescopic module 141 of the collection module 104. The control circuit 105 is an independently powered electric circuit. By independently powered is meant that the control circuit 105 can operate without an electrical connection to an external power source 204. The control circuit 105 comprises a master switch 151, a vacuum circuit 152, an extension/retraction circuit 153, and a power circuit 154. The master switch 151, the vacuum circuit 152, the extension/retraction circuit 153, and the power circuit 154 are electrically interconnected.

The master switch 151 is an electric switch. The master switch 151 is a maintained switch. The maintained switch is defined elsewhere in this disclosure. The master switch 151 forms an electric connection between the power circuit 154 and the vacuum circuit 152. The master switch 151 forms an electric connection between the power circuit 154 and the extension/retraction circuit 153. The master switch 151 controls the flow of electricity between the power circuit 154 and the vacuum circuit 152. The master switch 151 controls the flow of electricity between the power circuit 154 and the extension/retraction circuit 153. The master switch 151 is the power switch of the invention 100.

The vacuum circuit 152 is an electric circuit. The vacuum circuit 152 converts electric energy into rotational energy used to power the operation of the vacuum pump 121. The vacuum circuit 152 generates an illumination that allows for the identification and capture of the elimination 107 of the companion animal 106 by the invention 100. The vacuum circuit 152 comprises a vacuum switch 181, a vacuum motor 182, and a lamp circuit 183. The lamp circuit 183 further comprises an LED 184 and a limit resistor 185. The vacuum switch 181, the vacuum motor 182, the lamp circuit 183, the LED 184, and the limit resistor 185 are electrically interconnected The vacuum switch 181 is a maintained switch. The maintained switch is defined elsewhere in this disclosure. The vacuum switch 181 forms an electric connection between the master switch 151 and the vacuum motor 182. The vacuum switch 181 forms an electric connection between the master switch 151 and the lamp circuit 183.

When the master switch 151 is in the closed position, the actuation of the vacuum switch 181 into the closed position will initiate the operation of the vacuum motor 182. When the master switch 151 is in the closed position, the actuation of the vacuum switch 181 into the closed position will illuminate the lamp circuit 183. The actuation of the vacuum switch 181 to the open position will discontinue the operation of the vacuum motor 182. The actuation of the vacuum switch 181 to the open position will discontinue the illumination of the lamp circuit 183. The actuation of the master switch 151 to the open position will discontinue the operation of the vacuum motor 182. The actuation of the master switch 151 to the open position will discontinue the illumination of the lamp circuit 183.

The vacuum motor 182 is an electric motor. The vacuum motor 182 converts electric energy drawn from the power circuit 154 into rotational energy. The vacuum motor 182 mechanically attaches to the vacuum pump 121 such that the rotation of the vacuum motor 182 provides the rotational energy required to operate the vacuum pump 121.

The lamp circuit 183 is an electric circuit. The lamp circuit 183 converts electric energy drawn from the power circuit 154 into a visible illumination used to illuminate the space that is exterior to the invention 100. The LED 184 is an electric circuit element known as a light emitting diode. The LED 184 converts electric energy drawn from the power circuit 154 into the visible illumination generated by the lamp circuit 183. The limit resistor 185 is an electric circuit element known as a resistor. The limit resistor 185 electrically connects in series between the vacuum switch 181 and the LED 184. The limit resistor 185 limits the amount of electricity that flows through the LED 184.

The extension/retraction circuit 153 is an electric circuit. The extension/retraction circuit 153 provides the electrical energy to extend the telescopic module 141 for use. By extend is meant that first detent 171 and the second detent 172 are simultaneously adjusted such that the span of the length of the center axis of the composite prism structure of the telescopic module 141 is increased. The extension/retraction circuit 153 provides the electrical energy to retract the telescopic module 141 for use. By retract is meant that first detent 171 and the second detent 172 are simultaneously adjusted such that the span of the length of the center axis of the composite prism structure of the telescopic module 141 is decreased. The extension/retraction circuit 153 converts electric energy into rotational energy used to power the extension and the retraction of the first detent 171. The extension/retraction circuit 153 converts electric energy into rotational energy used to power the extension and the retraction of the second detent 172.

The extension/retraction circuit 153 comprises a first extension/retraction motor 191, a second extension/retraction motor 192, an extension/retraction switch 193, and a rotation direction switch 194. The first extension/retraction motor 191, the second extension/retraction motor 192, the extension/retraction switch 193, and the rotation direction switch 194 are electrically interconnected.

The first extension/retraction motor 191 is an electric motor. The first extension/retraction motor 191 converts electric energy drawn from the power circuit 154 into rotational energy. The first extension/retraction motor 191 mechanically attaches to the pinion of the first detent 171 such that the rotation of the first extension/retraction motor 191 provides the rotational energy required to move the rack of the first detent 171. The first extension/retraction motor 191 adjusts the span of the length of the center axis of the composite prism structure of the telescopic module 141 by providing the motive forces necessary to change the position of the first detent 171 and, by implication, the second arm 162 relative to the first arm 161.

The second extension/retraction motor 192 is an electric motor. The second extension/retraction motor 192 converts electric energy drawn from the power circuit 154 into rotational energy. The second extension/retraction motor 192 mechanically attaches to the pinion of the second detent 172 such that the rotation of the second extension/retraction motor 192 provides the rotational energy required to move the rack of the second detent 172. The second extension/retraction motor 192 adjusts the span of the length of the center axis of the composite prism structure of the telescopic module 141 by providing the motive forces necessary to change the position of the second detent 172 and, by implication, the third arm 163 relative to the second arm 162.

The extension/retraction switch 193 is a momentary switch. The momentary switch is defined elsewhere in this disclosure. The extension/retraction switch 193 is a normally open switch. The extension/retraction switch 193 forms an electric connection between the rotation direction switch 194. When the master switch 151 is in the closed position, the actuation of the extension/retraction switch 193 will transmit electric energy to the rotation direction switch 194.

The rotation direction switch 194 is a double pole double throw switch. The double pole double throw switch is defined elsewhere in this disclosure. The rotation direction switch 194 forms an electric connection between the extension/retraction switch 193 and the first extension/retraction motor 191. The rotation direction switch 194 forms an electric connection between the extension/retraction switch 193 and the second extension/retraction motor 192. The rotation direction switch 194 has a first position and a second position.

When the master switch 151 and the extension/retraction switch 193 are simultaneously in a closed position, the actuation of the rotation direction switch 194 into the second position will provide electric energy to the first extension/retraction motor 191 and the second extension/retraction motor 192 such that the first extension/retraction motor 191 and the second extension/retraction motor 192 will rotate in the second direction. The first directions of both the first extension/retraction motor 191 and the second extension/retraction motor 192 are the same.

When the master switch 151 and the extension/retraction switch 193 are simultaneously in a closed position, the actuation of the rotation direction switch 194 into the second position will provide electric energy to the first extension/retraction motor 191 and the second extension/retraction motor 192 such that the first extension/retraction motor 191 and the second extension/retraction motor 192 will rotate in the first direction. The second directions of both the first extension/retraction motor 191 and the second extension/retraction motor 192 are the same.

The actuation of the extension/retraction switch 193 to the open position will discontinue the operation of both the first extension/retraction motor 191 and the second extension/retraction motor 192. The actuation of the master switch 151 to the open position will discontinue the operation of both the first extension/retraction motor 191 and the second extension/retraction motor 192.

The power circuit 154 is an electrical circuit. The power circuit 154 powers the operation of the control circuit 105. The power circuit 154 is an electrochemical device. The power circuit 154 converts chemical potential energy into the electrical energy required to power the control circuit 105. The power circuit 154 comprises a battery 201, a diode 202, a charging port 203, and an external power source 204. The external power source 204 further comprises a charging plug 205. The battery 201, the diode 202, the charging port 203, the external power source 204, and the charging plug 205 are electrically interconnected. The battery 201 further comprises a first positive terminal 211 and a first negative terminal 221. The external power source 204 further comprises a second positive terminal 212 and a second negative terminal 222.

The battery 201 is an electrochemical device. The battery 201 converts chemical potential energy into the electrical energy used to power the control circuit 105.

The battery 201 is a commercially available rechargeable battery 201. The chemical energy stored within the rechargeable battery 201 is renewed and restored through the use of the charging port 203. The charging port 203 is an electrical circuit that reverses the polarity of the rechargeable battery 201 and provides the energy necessary to reverse the chemical processes that the rechargeable battery 201 initially used to generate the electrical energy. This reversal of the chemical process creates a chemical potential energy that will later be used by the rechargeable battery 201 to generate electricity.

The charging port 203 forms an electrical connection to the external power source 204 using the charging plug 205. The charging plug 205 forms a detachable electrical connection with the charging port 203. The charging port 203 receives electrical energy from the external power source 204 through the charging plug 205. The diode 202 is an electrical device that allows current to flow in only one direction. The diode 202 installs between the rechargeable battery 201 and the charging port 203 such that electricity will not flow from the first positive terminal 211 of the rechargeable battery 201 into the second positive terminal 212 of the external power source 204.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Bag: As used in this disclosure, a bag is a container made of a flexible material. The bag has a single opening which allows the bag to receive the items to be contained.

Battery: As used in this disclosure, a battery is a chemical device consisting of one or more cells, in which chemical energy is converted into electricity and used as a source of power. Batteries are commonly defined with a positive terminal and a negative terminal.

Befoulment: As used in this disclosure, befoulment refers to the excrement and other biological eliminations of a companion animal.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Closed Position: As used in this disclosure, a closed position refers to a movable barrier structure that is in an orientation that prevents passage through a port or an aperture. The closed position is often referred to as an object being "closed." Always use orientation.

Companion Animal: As used in this disclosure, a companion animal is a domesticated animal that is maintained primarily for companionship. A companion animal is often referred to as a pet.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Control Circuit: As used in this disclosure, a control circuit is an electrical circuit that manages and regulates the behavior or operation of a device.

Correspond: As used in this disclosure, the term correspond is used as a comparison between two or more objects wherein one or more properties shared by the two or more objects match, agree, or align within acceptable manufacturing tolerances.

Diode: As used in this disclosure, a diode is a two terminal semiconductor device that allows current flow in only one direction. The two terminals are called the anode and the cathode. Electric current is allowed to pass from the anode to the cathode.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Electric Motor: In this disclosure, an electric motor is a machine that converts electric energy into rotational mechanical energy. An electric motor typically comprises a stator and a rotor. The stator is a stationary hollow cylindrical structure that forms a magnetic field. The rotor is a magnetically active rotating cylindrical structure that is coaxially mounted in the stator. The magnetic interactions between the rotor and the stator physically causes the rotor to rotate within the stator thereby generating rotational mechanical energy. This disclosure assumes that the power source is an externally provided source of DC electrical power. The use of DC power is not critical and AC power can be used by exchanging the DC electric motor with an AC motor that has a reversible starter winding.

Elimination: As used in this disclosure, an elimination refers to a solid phase discharge from a biological entity.

Excretion: As used in this disclosure, an excretion refers to a liquid phase discharge from a biological entity.

External Power Source: As used in this disclosure, an external power source is a source of the energy that is externally provided to enable the operation of the present disclosure. Examples of external power sources include, but are not limited to, electrical power sources and compressed air sources.

Filter: As used in this disclosure, a filter is a mechanical device that is used to separate solids that are suspended in a liquid or a gas. A strainer is type of filter with what would be considered a coarse mesh measurement.

Flap: As used in this disclosure, a flap is a disk that is hinged on one side of the lateral face of a disk using one side such that the flap rotates to cover an aperture.

Fluid: As used in this disclosure, a fluid refers to a state of matter wherein the matter is capable of flow and takes the shape of a container it is placed within. The term fluid commonly refers to a liquid or a gas.

Fluid Plug: As used in this disclosure, a fluid plug is an object that blocks flow into and out of a cavity, an aperture, or a fluid port.

Fluid Port: As used in this disclosure, a fluid port is an opening formed in an object that allows fluid to flow through the boundary of the object.

Fluidic Connection: As used in this disclosure, a fluidic connection refers to a tubular structure that transports a fluid from a first object to a second object. Methods to design and use a fluidic connections are well-known and documented in the mechanical, chemical, and plumbing arts.

Form Factor: As used in this disclosure, the term form factor refers to the size and shape of an object.

Gas: As used in this disclosure, a gas refers to a state (phase) of matter that is fluid and that fills the volume of the structure that contains it. Stated differently, the volume of a gas always equals the volume of its container.

Gear: As used in this disclosure, a gear is a toothed wheel, cylinder, or other toothed mechanical element that is used to transmit motion, a change of speed, or a change of direction to a second toothed wheel, cylinder, or other toothed mechanical element.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Grip: As used in this disclosure, a grip is an accommodation formed on or within an object that allows the object to be grasped or manipulated by a hand.

Handle: As used in this disclosure, a handle is an object by which a tool, object, or door is held or manipulated with the hand.

Hinge: As used in this disclosure, a hinge is a device that permits the turning, rotating, or pivoting of a first object relative to a second object. A hinge designed to be fixed into a set position after rotation is called a locking hinge. A spring loaded hinge is a hinge formed as an elastic structure. The elastic structure of the spring loaded hinge is deformed under a rotating force such that the elastic structure returns the spring loaded hinge back to its relaxed shape after the rotating force is removed from the spring loaded hinge.

Housing: As used in this disclosure, a housing is a rigid structure that encloses and protects one or more devices.

Inner Dimension: As used in this disclosure, the term inner dimension describes the span from a first inside or interior surface of a container to a second inside or interior surface of a container. The term is used in much the same way that a plumber would refer to the inner diameter of a pipe.

Lamp: As used in this disclosure, a lamp is an electrical circuit that generates (typically visible spectrum) electromagnetic radiation.

Latch: As used in this disclosure, a latch is a fastening or locking mechanism commonly used to secure a lid, a door, or a gate.

LED: As used in this disclosure, an LED is an acronym for a light emitting diode. A light emitting diode is a diode that is also a light source.

Limit Resistor: As used in this disclosure, a limit resistor is an electrical resistor that is used to limit the flow of electric current through an electrical circuit.

Liquid: As used in this disclosure, a liquid refers to a state (phase) of matter that is fluid and that maintains, for a given pressure, a fixed volume that is independent of the volume of the container.

Loop: As used in this disclosure, a loop is the length of a first linear structure including, but not limited to, shafts, lines, cords, or webbings, that is: 1) folded over and joined at the ends forming an enclosed space; or, 2) curved to form a closed or nearly closed space within the first linear structure. In both cases, the space formed within the first linear structure is such that a second linear structure such as a line, cord or a hook can be inserted through the space formed within the first linear structure. Within this disclosure, the first linear structure is said to be looped around the second linear structure.

Maintained Switch: A used in this disclosure, a maintained switch is a switch that maintains the position that was set in the most recent switch actuation. A maintained switch works in an opposite manner to a momentary switch.

Momentary Switch: As used in this disclosure, a momentary switch is a biased switch in the sense that the momentary switch has a baseline position that only changes when the momentary switch is actuated (for example when a pushbutton switch is pushed or a relay coil is energized). The momentary switch then returns to the baseline position once the actuation is completed. This baseline position is called the "normal" position. For example, a "normally open" momentary switch interrupts (open) the electric circuit in the baseline position and completes (closes) the circuit when the momentary switch is activated. Similarly, a "normally closed" momentary switch will complete (close) an electric circuit in the baseline position and interrupt (open) the circuit when the momentary switch is activated.

Motor: As used in this disclosure, a motor refers to the method of transferring energy from an external power source into rotational mechanical energy.

Negative Space: As used in this disclosure, negative space is a method of defining an object through the use of open or empty space as the definition of the object itself, or, through the use of open or empty space to describe the boundaries of an object.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Open Position: As used in this disclosure, an open position refers to a movable barrier structure that is in an orientation that allows passage through a port or an aperture. The open position is often referred to as an object being "open."

Orientation: As used in this disclosure, orientation refers to the positioning of a first object relative to: 1) a second object; or, 2) a fixed position, location, or direction.

Outer Dimension: As used in this disclosure, the term outer dimension describes the span from a first exterior or outer surface of a tube or container to a second exterior or outer surface of a tube or container. The term is used in much the same way that a plumber would refer to the outer diameter of a pipe.

Perimeter: As used in this disclosure, a perimeter is one or more curved or straight lines that bounds an enclosed area on a plane or surface. The perimeter of a circle is commonly referred to as a circumference.

Phase: As used in this disclosure, phase refers to the state of the form of matter. The common states of matter are solid, liquid, gas, and plasma.

Pivot: As used in this disclosure, a pivot is a rod or shaft around which an object rotates or swings.

Plug: As used in this disclosure, a plug is an electrical termination that electrically connects a first electrical circuit to a second electrical circuit or a source of electricity. As used in this disclosure, a plug will have two or three metal pins.

Poles, Throws, and Switches: As used in this disclosure, the terms pole and throw are descriptions associated with an electrical switch. A pole refers to an electrical circuit the switch feeds electrical current into. The number of poles associated with the switch refers to the maximum number of independent circuits a switch can theoretically support. Because the circuits supported by the poles of a switch can be interconnected, a switch will often support fewer independent electrical circuits than the actual number of poles. The number of throws associated with a switch refers to the maximum number of electrical connections that can be made within an individual pole of the switch.

Port: As used in this disclosure, a port is an electrical termination that is used to connect a first electrical circuit to a second external electrical circuit. In this disclosure, the port is designed to receive a plug.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Pump: As used in this disclosure, a pump is a mechanical device that uses suction or pressure to raise or move fluids, compress fluids, or force a fluid into an inflatable object. Within this disclosure, a compressor refers to a pump that is dedicated to compressing a fluid or placing a fluid under pressure.

Rack and Pinion: As used in this disclosure, a rack and pinion is a gearing system that is designed to convert rotational energy into linear energy or the reverse. The rack is a toothed shaft that moves in a linear manner. The pinion is a gear (generally mounted on a rotating shaft) that interacts with the rack such that when the pinion rotates the rack is moved in a linear direction. Reversing the direction of rotation of the pinion will reverse the direction of the rack. Rack and pinion systems are well known and documented in the mechanical arts.

Relaxed Shape: As used in this disclosure, a structure is considered to be in its relaxed state when no shear, strain, or torsional forces are being applied to the structure.

Resistance: As used in this disclosure, resistance refers to the opposition provided by an electrical circuit (or circuit element) to the electrical current created by a DC voltage is presented across the electrical circuit (or circuit element). The term impedance is often used for resistance when referring to an AC voltage that is presented across the electrical circuit (or circuit element).

Resistor: As used in this disclosure, a resistor is a well-known and commonly available electrical device that presents a resistance that inhibits the flow of electricity through an electric circuit. Within an electric circuit processing alternating currents, the resistor will not affect the phase of the alternating current. A current flowing through a resistor will create a voltage across the terminals of the resistor.

Rigid Structure: As used in this disclosure, a rigid structure is a solid structure formed from an inelastic material that resists changes in shape. A rigid structure will permanently deform as it fails under a force.

Solid: As used in this disclosure, a solid refers to a state (phase) of matter that: 1) has a fixed volume; and, 2) does not flow.

Spring: As used in this disclosure, a spring is a device that is used to store mechanical energy. This mechanical energy will often be stored by: 1) deforming an elastomeric material that is used to make the device; 2) the application of a torque to a semi-rigid structure; or 3) a combination of the previous two items.

Surface Filter: As used in this disclosure, a surface filter is a type of filter wherein the fluid is passed through a surface or membrane, such as a screen or paper that allows for the passage of the fluid but blocks the passage of larger particles that may be suspended in the fluid. The construction of a surface filter would allow for the passage of the fluid through several filter surfaces in one filtration unit.

Switch: As used in this disclosure, a switch is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch respectively. Completing or interrupting an electric circuit is also often referred to as making or breaking the circuit respectively.

Telescopic: As used in this disclosure, telescopic is an adjective that describes a composite prism structure made of hollow prism-shaped sections that fit or slide into each other such that the composite prism structure can be made longer or shorter by adjusting the relative positions of the hollow prism-shaped sections.

Tube: As used in this disclosure, a tube is a hollow prism-shaped device formed with two open congruent ends. The tube is used for transporting liquids (including bulk solids) and gases. The line that connects the center of the first congruent face of the prism to the center of the second congruent face of the prism is referred to as the center axis of the tube or the centerline of the tube. When two tubes share the same centerline they are said to be aligned. When the centerlines of two tubes are perpendicular to each other, the tubes are said to be perpendicular to each other. In this disclosure, the terms inner dimensions of a tube and outer dimensions of a tube are used as they would be used by those skilled in the plumbing arts.

Vacuum: As used in this disclosure, vacuum is used to describe a first space that contains gas at a reduced gas pressure relative to the gas pressure of a second space. If the first space and the second space are connected together, this pressure differential will cause gas from the second space to move towards the first space until the pressure differential is eliminated.

Vacuum Cleaner: As used in this disclosure, a vacuum cleaner is a domestic appliance that generates a suction used to remove debris from a surface. A "wet-dry vacuum" refers to a vacuum cleaner that: a) passes the removed debris through a water reservoir; and/or, b) is capable of removing fluid from a surface.

With respect to the above description, it is to be realized that the optimum dimensional relationship for the various components of the invention described above and in FIGS. 1 through 7 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A pet waste vacuum comprising a housing module, a vacuum module, a storage module, a collection module, and a control circuit;

wherein the housing contains the vacuum module, the storage module, a collection module, and the control circuit;

wherein the pet waste vacuum is a vacuum cleaner that is configured for use in picking up the elimination of a companion animal from a surface;

wherein the storage module is the structure that receives and contains the elimination;

wherein the vacuum module generates a pressure differential that pumps an air flow through the collection module and the storage module into the vacuum module;

wherein the control circuit is an electric circuit that: a) controls the operation of the pet waste vacuum; and, b) provides the electrical energy necessary to operate the pet waste vacuum;

wherein the housing module forms the exterior shell of the pet waste vacuum;

wherein the housing module contains the vacuum module, the storage module, the collection module, and the control circuit, and the collected elimination from the companion animal;

wherein the mass of the air flow passing through the pet waste vacuum draws the elimination of the companion animal through the collection module into the storage module;

wherein the elimination of the companion animal is captured in the storage module;

wherein the storage module receives that air and the elimination of the companion animal pumped by the vacuum module through the collection module;

wherein the storage module filters the solid matter from the air flow that is drawn into the storage module;

wherein the storage module discharges the filtered airflow into the vacuum module;

wherein the collection module forms a plurality of intake ports used to draw the air and the elimination of the companion animal into the pet waste vacuum;

wherein the collection module incorporates a telescopic structure.

2. The pet waste vacuum according to claim 1 wherein the control circuit is an electric circuit;

wherein the control circuit powers the operation of the vacuum module and the collection module;

wherein the control circuit controls the operation of the vacuum module and the collection module;

wherein the control circuit generates an illumination that allows for the identification and capture of the elimination of the companion animal;

wherein the control circuit is an independently powered electric circuit;

wherein by independently powered is meant that the control circuit can operate without an electrical connection to an external power source.

3. The pet waste vacuum according to claim 2 wherein the housing module comprises a master housing and a vacuum housing;

wherein the master housing contains the storage module and the collection module;

wherein the vacuum housing contains the vacuum module and the control circuit;

wherein the master housing is a rigid casing;

wherein the master housing contains the storage module, the collection module, and the control circuit;

wherein the vacuum housing is a rigid casing;

wherein the vacuum housing contains the vacuum module.

4. The pet waste vacuum according to claim 3 wherein the vacuum module comprises a vacuum pump and a vacuum filter;

wherein the air flow passing through the pet waste vacuum is filtered for particulates before entering the vacuum pump;

wherein the vacuum pump generates the pressure differential that draws air through the collection module and the storage module;

wherein the vacuum pump generates the pressure differential necessary to receive the air flow into the vacuum module;

wherein the vacuum pump generates the pressure differential necessary to discharge the air flow from the vacuum module.

5. The pet waste vacuum according to claim 4
wherein the storage module comprises a containment shell, a containment bag, an intake port, and a flap valve;
wherein the containment shell contains the containment bag, the intake port, and the flap valve;
wherein the containment bag removably attaches to the intake port;
wherein the containment bag encloses the intake port such that everything that passes through the intake port is captured within the containment bag;
wherein the flap valve is a valve that attaches to the intake port;
wherein the intake port is a fluid port;
wherein the intake port forms a fluidic connection between the collection module and the storage module.

6. The pet waste vacuum according to claim 5
wherein the collection module comprises a telescopic module and an auxiliary port;
wherein the telescopic module is a tubular structure;
wherein the telescopic module forms a fluidic connection between the exterior of the pet waste vacuum and the storage module;
wherein the telescopic module receives the elimination of the companion animal into the pet waste vacuum;
wherein the vacuum generated by the vacuum module provides the motive forces that: a) draw the elimination into the telescopic module; and, b) transport the elimination through the telescopic module into the storage module;
wherein the span of the length of the center axis of the telescopic module is adjustable;
wherein the control circuit extends and retracts the telescopic module of the collection module.

7. The pet waste vacuum according to claim 6
wherein the control circuit comprises a master switch, a vacuum circuit, an extension/retraction circuit, and a power circuit;
wherein the master switch, the vacuum circuit, the extension/retraction circuit, and the power circuit are electrically interconnected.

8. The pet waste vacuum according to claim 7
wherein the vacuum pump is a mechanical structure;
wherein the vacuum pump is an electrically powered structure;
wherein the control circuit powers the operation of the vacuum pump;
wherein the control circuit controls the operation of the vacuum pump;
wherein the vacuum pump is a rotating structure;
wherein the vacuum filter is a surface filter;
wherein the vacuum filter protects the vacuum pump from damage by the filtered particulates.

9. The pet waste vacuum according to claim 8
wherein the containment shell is a rigid structure;
wherein the containment shell is a hollow structure;
wherein the containment bag is a gas permeable bag;
wherein the containment bag stores the elimination of the companion animal in anticipation of disposal;
wherein the containment bag attaches to and encloses the intake port such that the elimination of the companion animal is contained within the intake port immediately on entry into the storage module;
wherein the flap valve is a rotating structure;
wherein the flap valve rotates between putting the intake port into an open position and putting the intake port into a closed position.

10. The pet waste vacuum according to claim 9
wherein the telescopic module is a telescopic structure that comprises a first arm, a second arm, and a first detent;
wherein the first detent is a mechanical device that locks and secures the first arm to the second arm;
wherein the first arm is a hollow structure that is further defined with an inner dimension;
wherein the second arm is a hollow structure that is further defined with an outer dimension;
wherein the second arm is geometrically similar to the first arm;
wherein the span of the outer dimension of the second arm is lesser than the span of the inner dimension of the first arm such that the second arm inserts into the first arm in a telescopic fashion;
wherein the span of the length of the telescopic module adjusts by adjusting the relative position of the second arm within the first arm;
wherein the position of the second arm relative to the first arm is held in position using the first detent.

11. The pet waste vacuum according to claim 10
wherein the telescopic module further comprises a third arm, and a second detent;
wherein the second detent is a mechanical device that locks and secures the third arm to the second arm;
wherein the second arm is a hollow structure that is further defined with an inner dimension;
wherein the third arm is a hollow structure that is further defined with an outer dimension;
wherein the third arm is geometrically similar to the second arm;
wherein the span of the outer dimension of the third arm is lesser than the span of the inner dimension of the second arm such that the third arm inserts into the second arm in a telescopic fashion;
wherein the span of the length of the telescopic module adjusts by adjusting the relative position of the third arm within the second arm;
wherein the position of the third arm relative to the second arm is held in position using the second detent.

12. The pet waste vacuum according to claim 11
wherein the first detent and the second detent are rack and pinion structures;
wherein the pinion of the first detent attaches to the first arm;
wherein the rack of the first detent attaches to the second arm;
wherein the pinion of the first detent attaches to the control circuit such that the control circuit controls the rotation of the pinion relative to the rack;
wherein the rotation of the pinion of the first detent moves the rack of the first detent such that the second arm moves relative to the first arm;
wherein the pinion of the second detent attaches to the second arm;
wherein the rack of the second detent attaches to the third arm;
wherein the pinion of the second detent attaches to the control circuit such that the control circuit controls the rotation of the pinion relative to the rack;
wherein the rotation of the pinion of the second detent moves the rack of the second detent such that the third arm moves relative to the second arm.

13. The pet waste vacuum according to claim 12
wherein the auxiliary port is a fluid port that is formed in the containment shell of the storage module;

wherein the auxiliary port forms a fluidic connection between the exterior of the pet waste vacuum and the storage module;

wherein the vacuum generated by the vacuum module provides the motive forces that: a) draw the elimination into the auxiliary port; and, b) transport the elimination through the auxiliary port into the containment bag of the storage module;

wherein the auxiliary port further comprises an auxiliary plug;

wherein the auxiliary plug is a fluid plug;

wherein the auxiliary plug inserts into the auxiliary port when the auxiliary port is not in use;

wherein the auxiliary plug forms a fluid impermeable seal with the auxiliary port.

14. The pet waste vacuum according to claim 13 wherein the master switch is an electric switch;

wherein the master switch is a maintained switch;

wherein the master switch forms an electric connection between the power circuit and the vacuum circuit;

wherein the master switch forms an electric connection between the power circuit and the extension/retraction circuit;

wherein the master switch controls the flow of electricity between the power circuit and the vacuum circuit;

wherein the master switch controls the flow of electricity between the power circuit and the extension/retraction circuit;

wherein the master switch is the power switch of the pet waste vacuum;

wherein the vacuum circuit is an electric circuit;

wherein the vacuum circuit converts electric energy into rotational energy used to power the operation of the vacuum pump;

wherein the vacuum circuit generates an illumination that allows for the identification and capture of the elimination of the companion animal by the pet waste vacuum;

wherein the extension/retraction circuit is an electric circuit;

wherein the extension/retraction circuit provides the electrical energy to extend the telescopic module for use;

wherein by extend is meant that first detent and the second detent are simultaneously adjusted such that the span of the length of the center axis of the telescopic module is increased;

wherein the extension/retraction circuit provides the electrical energy to retract the telescopic module for use;

wherein by retract is meant that first detent and the second detent are simultaneously adjusted such that the span of the length of the center axis of the telescopic module is decreased;

wherein the extension/retraction circuit converts electric energy into rotational energy used to power the extension and the retraction of the first detent;

wherein the extension/retraction circuit converts electric energy into rotational energy used to power the extension and the retraction of the second detent;

wherein the power circuit is an electrical circuit;

wherein the power circuit powers the operation of the control circuit;

wherein the power circuit is an electrochemical device;

wherein the power circuit converts chemical potential energy into the electrical energy required to power the control circuit.

15. The pet waste vacuum according to claim 14 wherein the vacuum circuit comprises a vacuum switch, a vacuum motor, and a lamp circuit;

wherein the lamp circuit further comprises an LED and a limit resistor;

wherein the vacuum switch, the vacuum motor, the lamp circuit, the LED, and the limit resistor are electrically interconnected;

wherein the extension/retraction circuit comprises a first extension/retraction motor, a second extension/retraction motor, an extension/retraction switch, and a rotation direction switch;

wherein the first extension/retraction motor, the second extension/retraction motor, the extension/retraction switch, and the rotation direction switch are electrically interconnected;

wherein the power circuit comprises a battery, a diode, a charging port, and an external power source;

wherein the external power source further comprises a charging plug;

wherein the battery, the diode, the charging port, the external power source, and the charging plug are electrically interconnected;

wherein the battery further comprises a first positive terminal and a first negative terminal;

wherein the external power source further comprises a second positive terminal and a second negative terminal.

16. The pet waste vacuum according to claim 15 wherein the vacuum switch is a maintained switch;

wherein the vacuum switch forms an electric connection between the master switch and the vacuum motor;

wherein the vacuum switch forms an electric connection between the master switch and the lamp circuit;

wherein when the master switch is in the closed position, the actuation of the vacuum switch into the closed position will initiate the operation of the vacuum motor;

wherein when the master switch is in the closed position, the actuation of the vacuum switch into the closed position will illuminate the lamp circuit;

wherein the actuation of the vacuum switch to the open position will discontinue the operation of the vacuum motor;

wherein the actuation of the vacuum switch to the open position will discontinue the illumination of the lamp circuit;

wherein the actuation of the master switch to the open position will discontinue the operation of the vacuum motor;

wherein the actuation of the master switch to the open position will discontinue the illumination of the lamp circuit;

wherein the vacuum motor is an electric motor;

wherein the vacuum motor converts electric energy drawn from the power circuit into rotational energy;

wherein the vacuum motor mechanically attaches to the vacuum pump such that the rotation of the vacuum motor provides the rotational energy required to operate the vacuum pump;

wherein the lamp circuit is an electric circuit;

wherein the lamp circuit converts electric energy drawn from the power circuit into a visible illumination used to illuminate the space that is exterior to the pet waste vacuum;

wherein the LED is an electric circuit element known as a light emitting diode;

wherein the LED converts electric energy drawn from the power circuit into the visible illumination generated by the lamp circuit;

wherein the limit resistor is an electric circuit element known as a resistor;

wherein the limit resistor electrically connects in series between the vacuum switch and the LED;

wherein the first extension/retraction motor is an electric motor;

wherein the first extension/retraction motor converts electric energy drawn from the power circuit into rotational energy;

wherein the first extension/retraction motor mechanically attaches to the pinion of the first detent such that the rotation of the first extension/retraction motor provides the rotational energy required to move the rack of the first detent;

wherein the first extension/retraction motor adjusts the span of the length of the center axis of the telescopic module by providing the motive forces necessary to change the position of the first detent and, by implication, the second arm relative to the first arm;

wherein the second extension/retraction motor is an electric motor;

wherein the second extension/retraction motor converts electric energy drawn from the power circuit into rotational energy;

wherein the second extension/retraction motor mechanically attaches to the pinion of the second detent such that the rotation of the second extension/retraction motor provides the rotational energy required to move the rack of the second detent;

wherein the second extension/retraction motor adjusts the span of the length of the center axis telescopic module by providing the motive forces necessary to change the position of the second detent and, by implication, the third arm relative to the second arm;

wherein the extension/retraction switch is a momentary switch;

wherein the extension/retraction switch is a normally open switch;

wherein the extension/retraction switch forms an electric connection between the rotation direction switch;

wherein when the master switch is in the closed position, the actuation of the extension/retraction switch will transmit electric energy to the rotation direction switch;

wherein the rotation direction switch is a double pole double throw switch;

wherein the rotation direction switch forms an electric connection between the extension/retraction switch and the first extension/retraction motor;

wherein the rotation direction switch forms an electric connection between the extension/retraction switch and the second extension/retraction motor;

wherein the rotation direction switch has a first position and a second position;

wherein when the master switch and the extension/retraction switch are simultaneously in a closed position, the actuation of the rotation direction switch into the second position will provide electric energy to the first extension/retraction motor and the second extension/retraction motor such that the first extension/retraction motor and the second extension/retraction motor will rotate in the second direction;

wherein the first directions of both the first extension/retraction motor and the second extension/retraction motor are the same;

wherein when the master switch and the extension/retraction switch are simultaneously in a closed position, the actuation of the rotation direction switch into the second position will provide electric energy to the first extension/retraction motor and the second extension/retraction motor such that the first extension/retraction motor and the second extension/retraction motor will rotate in the first direction;

wherein the second directions of both the first extension/retraction motor and the second extension/retraction motor are the same;

wherein the actuation of the extension/retraction switch to the open position will discontinue the operation of both the first extension/retraction motor and the second extension/retraction motor;

wherein the actuation of the master switch to the open position will discontinue the operation of both the first extension/retraction motor and the second extension/retraction motor;

wherein the battery is a rechargeable battery;

wherein the charging port is an electrical circuit that reverses the polarity of the rechargeable;

wherein the charging port forms an electrical connection to the external power source using the charging plug;

wherein the charging plug forms a detachable electrical connection with the charging port;

wherein the charging port receives electrical energy from the external power source through the charging plug;

wherein the diode is an electrical device that allows current to flow in only one direction;

wherein the diode installs between the rechargeable battery and the charging port such that electricity will not flow from the first positive terminal of the rechargeable battery into the second positive terminal of the external power source.

17. The pet waste vacuum according to claim 16 wherein the vacuum housing comprises a plurality of latches, a plurality of exhaust ports, and a handle;

wherein the plurality of latches forms a fastening device;

wherein the plurality of latches secures the vacuum module to the storage module;

wherein each of the plurality of exhaust ports is a fluid port formed through the vacuum housing;

wherein the air flow passing through the plurality of exhaust ports discharges through the plurality of exhaust ports;

wherein the handle is a grip that attaches to the exterior surface of the vacuum housing;

wherein the handle is used to carry and manipulate the pet waste vacuum.

18. The pet waste vacuum according to claim 17 wherein the flap valve comprises a valve plate and a valve hinge;

wherein the valve plate is a rigid structure;

wherein the valve plate has a disk structure;

wherein the valve plate forms a flap within the storage module;

wherein the valve plate is sized such that the valve plate encloses the intake port when the flap valve is rotated to the closed position;

wherein the valve hinge is a spring-loaded hinge;

wherein the valve hinge attaches the valve plate to the flap valve such that the valve plate rotates between the closed position and the open position;

wherein the spring structure of the valve hinge returns and secures the valve plate in the closed position.

* * * * *